US005662363A

United States Patent [19]

Gandhi

[11] Patent Number: 5,662,363

[45] Date of Patent: Sep. 2, 1997

[54] WINDOW LATCHING MECHANISM

[75] Inventor: Chandrahas O. Gandhi, Butler, Pa.

[73] Assignee: CertainTeed Corporation, Valley Forge, Pa.

[21] Appl. No.: 383,270

[22] Filed: Feb. 3, 1995

[51] Int. Cl.[6] ..... E05C 3/02

[52] U.S. Cl. ..... 292/230; 292/198; 292/DIG. 20

[58] Field of Search ..... 292/230, 234, 292/231, DIG. 20, DIG. 35, DIG. 47, 198

[56] References Cited

U.S. PATENT DOCUMENTS

| | | | |
|---|---|---|---|
| 538,678 | 5/1895 | Horner | 292/213 |
| 688,491 | 12/1901 | Sigler . | |
| 840,427 | 1/1907 | Brister | 292/230 |
| 881,658 | 3/1908 | Bowman . | |
| 884,099 | 4/1908 | Marden | 292/230 |
| 1,074,162 | 9/1913 | Carrette | 292/230 |
| 1,698,944 | 1/1929 | Foe . | |
| 3,122,797 | 3/1964 | Segre | 292/DIG. 20 X |
| 4,507,894 | 4/1985 | Anderson | 292/DIG. 47 X |
| 4,824,154 | 4/1989 | Simpson | 292/338 |
| 4,923,230 | 5/1990 | Simpson | 292/67 |
| 5,203,596 | 4/1993 | Stevens | 292/204 |
| 5,219,195 | 6/1993 | Lawrence | 292/336.3 |
| 5,248,174 | 9/1993 | Matz et al. | 292/338 |
| 5,253,904 | 10/1993 | Ruby | 292/58 |

*Primary Examiner*—Rodney M. Lindsey
*Attorney, Agent, or Firm*—Duane Morris & Heckscher

[57] ABSTRACT

Windows are provided including a latch member which is pivotably mounted to one of the support structures of the window. The latch member includes a body portion including first and second transverse ends. At one end is located a projecting portion which extends laterally from the body portion. This projecting portion includes a first contact surface which slides against a descending panel of the window when the panel is lowered into a closed position. This sliding action rotates the latch member away from the path of the lowering panel. Upon closing the panel, the latch member is then rotated substantially by gravitational force to a latching position along the panel to secure it in a closed position. This invention is particularly adapted to bug and security screens.

22 Claims, 3 Drawing Sheets

WINDOW LATCHING MECHANISM

FIELD OF THE INVENTION

This invention relates to locking mechanisms for windows, and in particular, to unobtrusive latching mechanisms that are designed to secure a window panel, such as a screen or window pane in a open or closed position.

BACKGROUND OF THE INVENTION

Window assemblies typically include a window frame and a pair of window sashes mounted for vertical reciprocal sliding movement, one relative to the other, on guide rails in a frame jamb. These assemblies also can include sash locks, security locks or locking assemblies which are either spring-loaded or manually activated to secure the window sashes or panels in a locked, closed position.

Many windows also include a pair of screen panels, also vertically mounted and capable of sliding movement. These panels are known to include spring-loaded devices mounted along the lower surfaces of one or both panels which extend laterally from the screen frame to engage slots along the window frame at regularly spaced intervals.

While manual locking systems for window sashes and screen panels are often effective, they are not always used. Spring-loaded or biased locking mechanisms substantially eliminate the problem of human error, but they tend to be expensive and often require maintenance to work properly. There is, therefore, a need for an inexpensive and easy-to-use automatic self-locking latch mechanism for window and screen panels.

SUMMARY OF THE INVENTION

Latching systems for windows are provided which include at least a first latch member pivotably mounted to a window support structure. This latch member includes a body portion having first and second transverse ends and at least one projecting portion extending laterally from the body portion. This projection includes a contact surface thereon which directs the latch member away from the path of a descending window or screen panel. After the edge of the panel passes by the latch member, the force of gravity causes a reverse rotation of the latch member so that the projecting portion overhangs a mating surface on the window or screen panel to latch it in a closed position.

Accordingly, improved windows are provided having inexpensive, automatically self-locking latching mechanisms. The latch can be equipped to secure insect screens, security screens, or window panels, and preferably has a one-piece molded construction so that it is easy to use and cost efficient to produce. Since the latch members of this invention do not require a spring mechanism to operate, they are relatively fool-proof and do not require lubrication or maintenance. Moreover, since these latch members are aesthetically unobtrusive, they do not detract from the overall pleasing appearance of the window.

In more preferred embodiments of this invention, latch mechanisms are provided which include a selflocking protrusion on the opposite end of the body portion than the projecting portion, which impinges against an inwardly facing surface of the window or screen panel to further secure against attempts to open the screen or window from the outside of a structure to which the window is secured. In further preferred embodiments, pairs of upper and lower latch members are provided to secure the window in both a closed and open position respectively.

BRIEF DESCRIPTION OF THE DRAWINGS

The accompanying drawings illustrate preferred embodiments of the invention as well as other information pertinent to the disclosure, and in which:

FIG. 6(*a*): is an alternative screen frame suitable for use with the latch members of this invention.

DETAILED DESCRIPTION OF THE INVENTION

Figure 1:
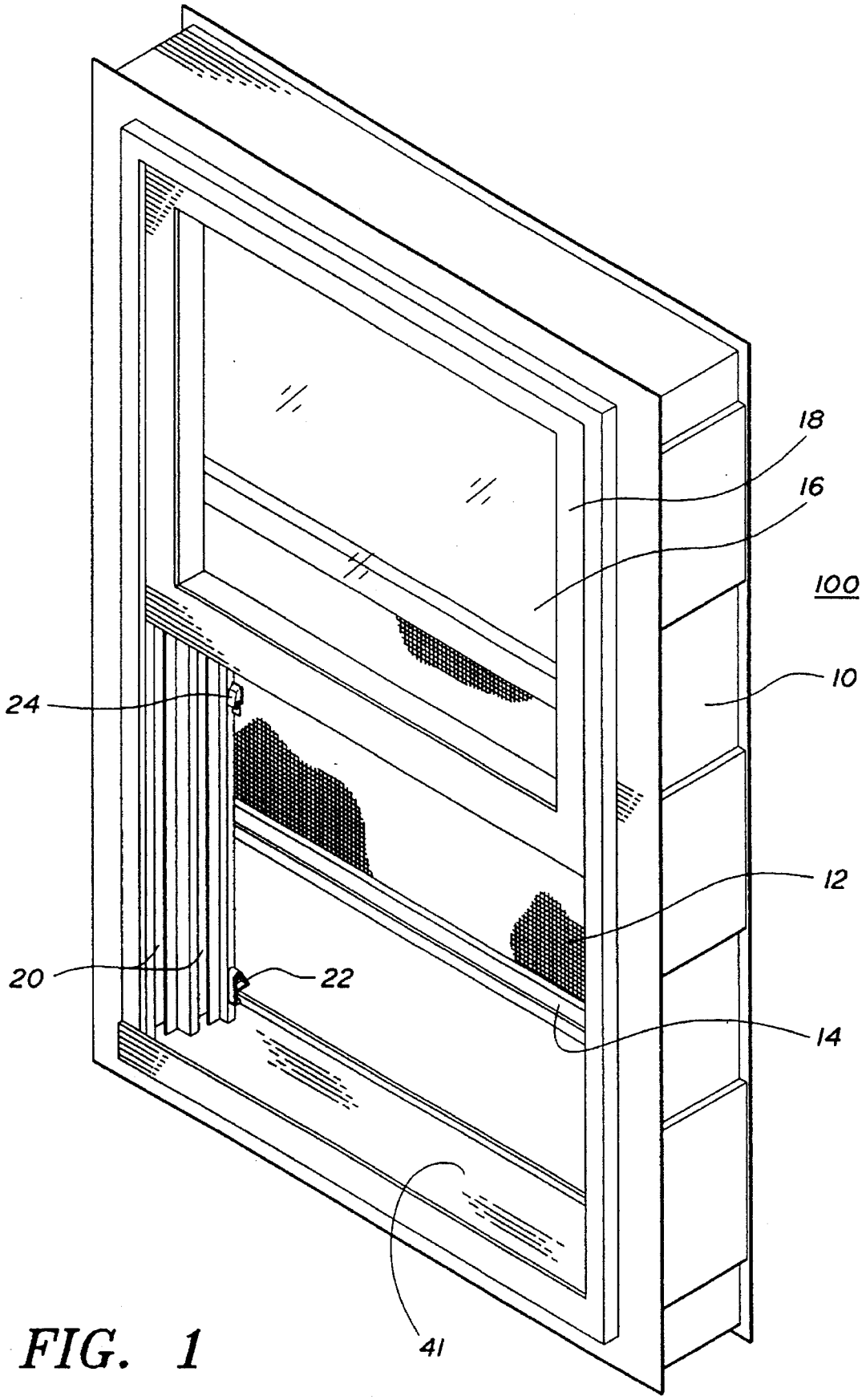
FIG. 1: is a perspective view of a double-hung window showing the placement of the preferred upper and lower latch members of this invention.
Figure 4:
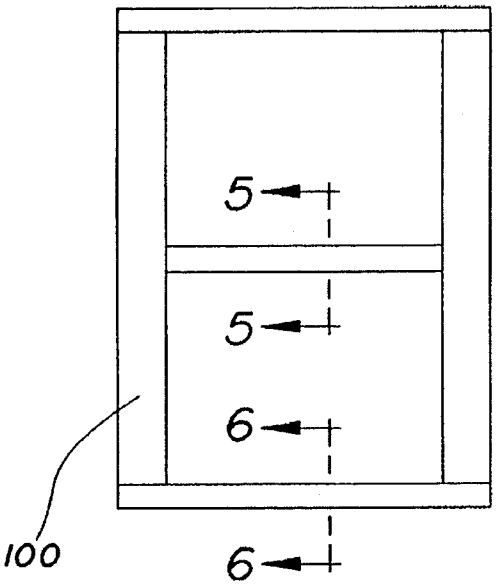
FIG. 4: is a front planer view of the double-hung window of FIG. 1.

With reference to the figures and particularly FIG. 1 thereof, there is shown a standard double-hung window assembly 100. This window assembly 100, as is typical in such constructions, includes a bottom horizontal frame member or sill 41, along with a pair of vertical frame members, commonly called jambs 10. This particular window also includes a screen panel 12 including a screen frame 14 and a window panel 16 including a window frame 18. Located on the inner surface of the jambs 10 is a plurality of window tracks 20, and one or more screen tracks (not shown). The concept of this invention is to provide a non-obtrusive, automatically actuated latching mechanism that can provide either a security latch in the closed position, such as exemplified by lower latch member 22, or a convenient means for maintaining the window or screen panel in an open position, such as exemplified by upper latch member 24.

The details of the upper and lower latch members 24 and 22 will now be described with reference to FIGS. 2 and 3. It is understood, however, that the principles of this invention can be carried out by numerous configurations which meet the same objectives and accomplish the same goals as the following designs, without deviating from the spirit of the present invention.

Figure 2:
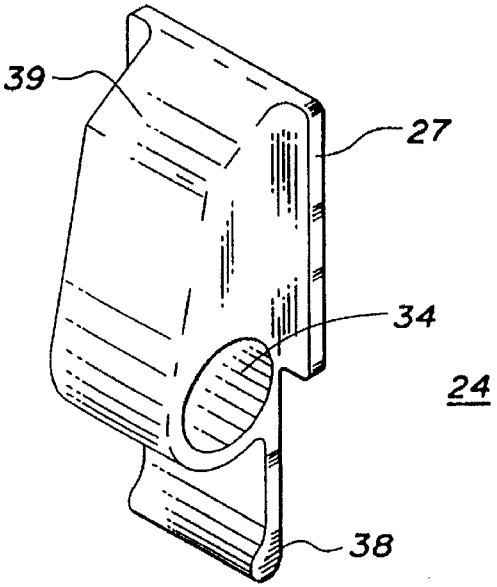
FIG. 2: is a perspective view of a preferred upper latch member of this invention.

With reference to FIG. 2, there is shown a preferred construction for the upper latch member 24. This member 24 is spaced vertically from the lower latch member 22 along a vertical support structure of the window, such as window jamb 10. The lower latch member 24 includes a contact surface 39 for supporting a panel in an open position. The contact surface is desirably disposed at an oblique angle to a central axis of the upper latch member 24 so that when it rotates under gravitational force, it presents a flat surface to contact a window or screen panel, and preferably a screen frame 14. The upper latch member also can include a transverse aperture 34 therethrough for receiving a fastener, such as a screw, nail, or rivet. It further includes a relatively flat flange portion 27 on one of its lateral sides which can be generally parallel with the central axis of the upper latch member 24. In order to facilitate disengagement of the upper latch 24, a grip member 38 is provided at one of the transverse ends of the upper latch 24. The grip member 38 may be serrated to facilitate use.

Figure 5:
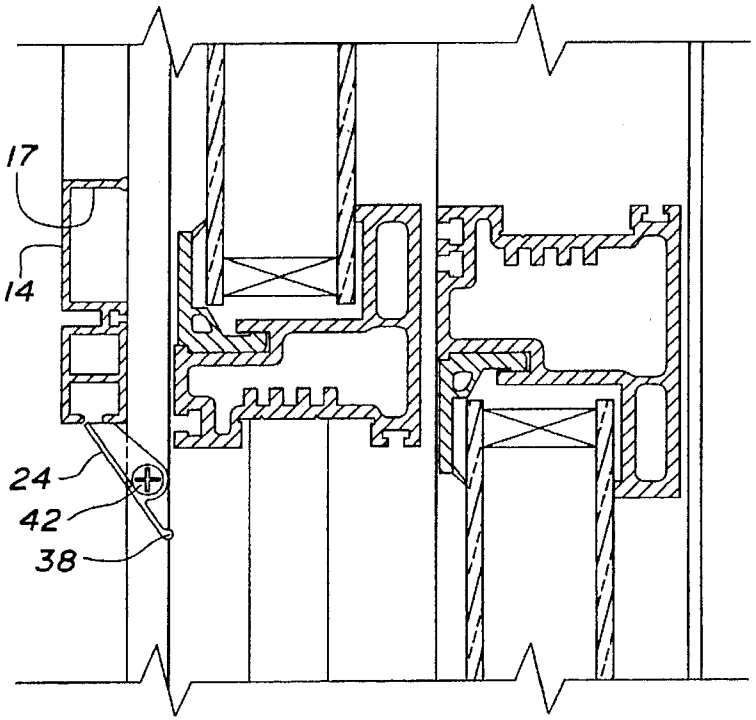
FIG. 5: is a side, cross-sectional view, taken through line 5—5 of FIG. 4, showing the preferred upper latch member in the latched position for a screen.

As described in FIG. 5, the upper latch member 24 permits the passage of the screen frame 14 as.it slides into an open position in screen tracks of the window 100. When the screen frame 14 is elevated to a vertical position beyond the upper latch member 24, the latch member 24 rotates outwardly to locate the contact surface 39 below an edge of the screen frame 14. Any mating surface will suffice for making latching contact, such as the frame bottom or screen frame edge 17. Since the preferred upper latch member 24 is top heavy and is designed to rotate freely about its fastener, the flat flange portion 27 is preferably designed to extend over and rest against a portion of the jamb, shown by the dotted line in FIG. 5. This guarantees a controlled amount of rotation so that the contact surface 39 is presented in a desired horizontal position with the mating surface of the screen frame 14. To release the upper latch member 24, one merely has to press down on the grip member 38 which causes the contact surface to be pulled away from frame 14 and into the window opening, thereby releasing frame 14 to travel in a downward direction.

Figure 3:
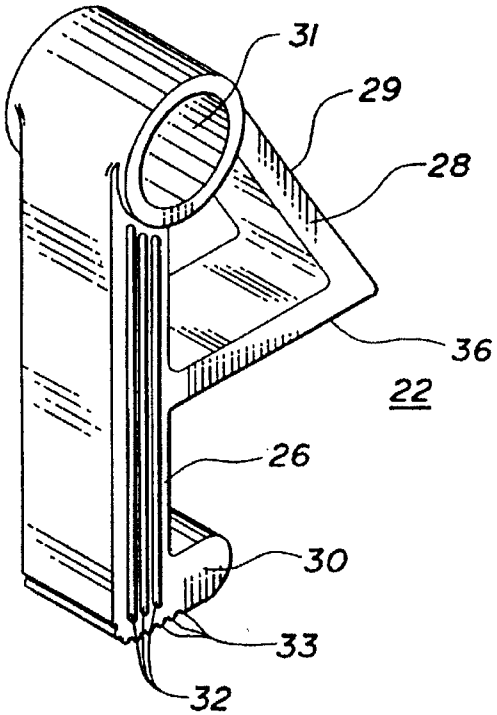
FIG. 3: is a perspective view of a preferred lower latch member of this invention.

With reference to FIG. 3, the preferred lower latch member 22 will now be described. This member 22 includes a body portion 26 including first and second transverse ends. The first end further includes a first projecting portion which extends laterally from the body portion 26. Preferably this projecting portion comprises a triangularly-shaped projection 28 having an oblique surface 29 and a lower contact surface 36. The body portion 26 optionally includes serrations 32 and 33 to promot$_e$ facilitated manual use. In one important variation of the lower latch member 22, a self-locking protrusion 30 can be provided on the second transverse end of the body portion 26. This self-locking protrusion 30 can impinge against an inwardly facing surface of the window at least when an attempt is made to lift the panel from the outside of a structure to which the window is secured.

Like the upper latch member 24, the preferred lower latch member 22 includes a transverse aperture 31 for receiving a similar fastener. Unlike the preferred upper latch member 24, however, the lower latch member is ideally weight balanced so that the body portion 26 is nearly vertical when member 22 is at rest about the fastener.

Figure 6:
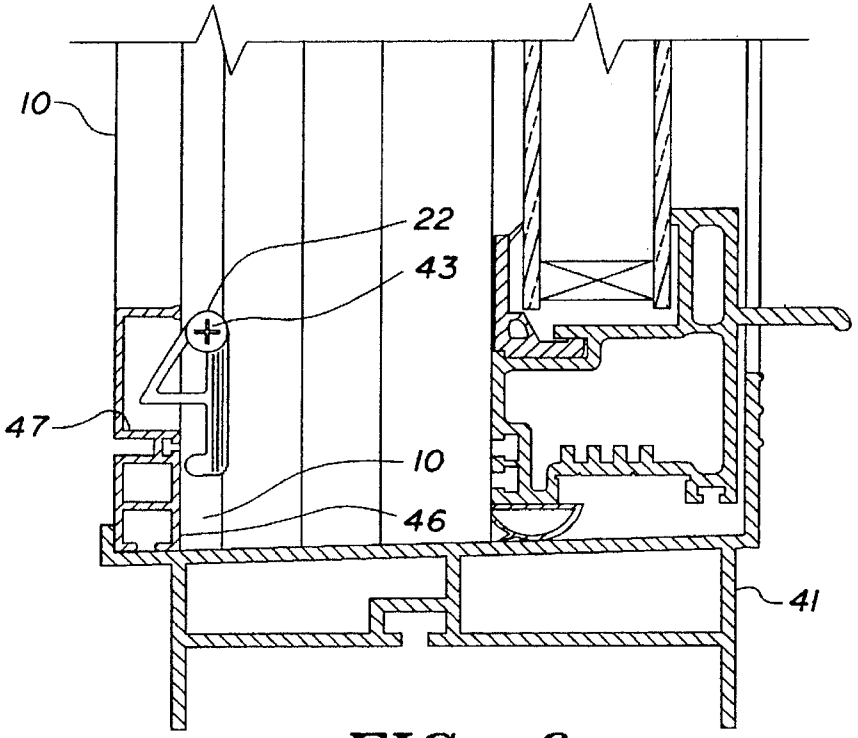
FIG. 6: is a side, cross-sectional view, taken through line 6—6 of FIG. 4, showing a preferred lower latch member in a locked position against a closed screen frame.
Figure 6A:
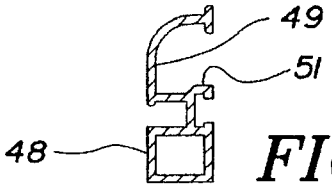

With reference to FIG. 6, the operation of the preferred lower latch member 22 will now be described. As the frame 14 is lowered from the open position, one of its lower surfaces contacts the oblique surface 29. This causes a rotation of the lower latch member 22 away from the screen frame 14 so that the screen frame 14 can drop to a closed position against the sill 41, or similar surface. At this point, the lower latch member 22 rotates in a reverse direction into the screen rail and rests against screen frame edge 47. The self-locking protrusion 30, if used, then rests against a lower surface of screen frame 14. There is preferably some clearance, e.g. 1 mm or more, at one or both points of contact between the frame 14 and member 22 so as to permit the rotation of the lower latch member 22 away from the screen frame 14 when it is manually unlatched.

Once in the latched position, the screen panel 12 is now located from the inside of the house or building, and any attempt to move the screen up from the outside of the structure makes the latch lock tighter because an upward force against the lower contact surface 36 presses the self-locking protrusion 30 against the inside surface of the screen frame 14 to prevent unlatching the mechanism.

As shown in FIG. 6(*a*), an alternative screen frame 48 can be provided including a curved screen rail 49. An alternative screen frame edge 51 would likely serve to more effectively help lock the lower contact surface 36 of the lower latch member 22 into position.

When the screen needs to be opened, the lower latch member (or members) 22 is just rotated with one's finger out of the way of the screen frame 14. This will allow the screen panel 12 to be opened to a raised position, and will permit the lower latch member 22 to rotate back into its normal vertical position substantially only by gravitational force where it can be ready to automatically lock the screen panel 12 on its next descent.

From the foregoing, it will be understood that this invention provides latching mechanisms for screen and window panels that will permit the screen to remain securely closed in bad weather, or when uninvited attempts are made to open the screen or window from the outside of the building. The devices of this invention will also prevent small children from accidentally unlatching the window or screen and causing injury. Although various embodiments have been illustrated, this was for the purpose of describing, and not limiting the invention. Various modifications, which will become apparent to one skilled in the art, within the scope of this invention as described in the attached claims.

I claim:

1. In a window having a support structure including a sill and a pair of vertical jambs, said window including a movable framed panel disposed in a pair of oppositely disposed tracks of said jambs for permitting the sliding of said panel from an open position to a closed position, the improvement comprising:

(a) a first latch member pivotally mounted to said support structure, said first latch member having a body portion including first and second transverse ends, said first end comprising a first projecting portion which extends laterally from said body portion, said first projecting portion including a first contact surface thereon for sliding against said panel when said panel is lowered to said closed position so that said first latch member is rotated away from the path of said lowering panel;

upon said panel obtaining said closed position, said first latch member is then rotated substantially by gravitational force to a latching position along said panel.

2. The window of claim 1 wherein said first latch member comprises a triangularly-shaped projection, a side of which comprises an oblique surface.

3. The window of claim 2 wherein said second transverse end comprises a self-locking protrusion which impinges against an inwardly facing surface of said window at least when an attempt is made to lift the panel from the outside of a structure to which the window is secured.

4. The window of claim 1 wherein said body portion comprises a transverse aperture therethrough.

5. The window of claim 4 wherein said latch member comprises a fastener disposed through said transverse aperture and mounted to one of said jambs.

6. The window of claim 1 comprising a pair of said latch members disposed on oppositely facing surfaces of said jambs.

7. The window of claim 1 further comprising a second latch member pivotably mounted to said support structure and spaced vertically from said first latch member, said second latch member having a body portion including first and second transverse ends, said first end of said second latch member comprising a first contact surface for sliding against said panel when said panel is raised to said open position so that said second latch member is rotated away from the path of said raising panel;

said second latch member also comprising a second contact surface which is rotated into a latching position along a mating surface of said panel substantially by gravitational force upon sliding said panel into said open position.

8. The window of claim 7 wherein said first and second latch members comprise serrated surface portions.

9. The window of claim 1 wherein said panel comprises a screen.

10. A window having a support structure including a sill and a pair of vertical jambs, said window further including a movable framed panel disposed in a pair of oppositely disposed tracks of said jambs for permitting the sliding of said panel from an open position to a closed position, comprising:

a first latch member pivotally mounted to said support structure, said latch member having a body portion including first and second transverse ends, said first end comprising a first projecting portion which extends laterally from said body portion, said first projecting portion having a lower surface thereon for latching against a mating surface along said panel substantially only by gravitational force; said second end comprising a self-locking protrusion which impinges against an inwardly facing surface of said window at least when a attempt is made to lift the panel from the outside of a structure to which the window is secured.

11. The window of claim 10 wherein said first projecting portion comprises a hollowed-out triangular portion.

12. The window of claim 11 wherein said selflocking protrusion is disposed on the same side of said body portion as said hollowed-out triangular portion.

13. The window of claim 12 wherein said latch member is weight balanced so that it positions itself vertically when pivoting freely under a gravitational force.

14. The window of claim 13 wherein said body portion comprises serrations.

15. The window of claim 11 wherein said body portion comprises a transverse aperture disposed therethrough at a first corner of said hollowed-out triangular portion.

16. The window of claim 10 wherein said first projecting portion extends laterally a greater distance than said self-locking protrusion.

17. The window of claim 10 wherein said panel comprises a screen.

18. A window having a sill, a pair of supporting jambs and a slidable, freed, screened panel disposed in a pair of oppositely disposed tracks within said jambs for permitting the sliding of said screened panel from an open position to a closed position, comprising:

(a) a first latch member pivotally mounted about a fastener to an inner surface of one of said jambs at a preselected distance from said sill, said latch member having a body portion and first and second transverse ends, said first end comprising a triangularly-shaped projecting portion which extends laterally from said body portion, said triangularly-shaped projecting portion having an oblique surface thereon for rotating said projecting portion away from said panel when contacted by said panel near said closed position; and said second ehd comprising a self-locking protrusion which impinges against an inner surface of said window automatically by gravitational force at least when an attempt is made to lift the panel from the outside of a structure to which the window is secured.

19. The window of claim 18 further comprising a second latch member disposed along an oppositely facing surface of the second of said jambs, said second latch member and said first latch member constituting a first pair of latch members.

20. The window of claim 19 further comprising a second pair of latch members disposed along an upper surface of said jambs and including a pair of first protecting portions, each of said second pair of latch members having a body portion including first and second transverse ends, said first projecting portions of said second pair of latch members including an oblique surface thereon which contacts said panel when said panel is raised to an open position so that said first projecting portion is rotated away from the path of said raising panel; upon obtaining an open position, said second pair of latch members are then rotated substantially by a gravitational force to a latching position along said panel.

21. The window of claim 20 wherein said first and second pairs of latch members are activated into a latching position substantially only by gravitational force and the motion of said panel.

22. The window of claim 21 wherein said first and second pairs of latch members comprise a molded one piece construction.

* * * * *